United States Patent [19]

Savenije

[11] Patent Number: 4,682,378

[45] Date of Patent: Jul. 28, 1987

[54] BODY SUPPORT, SUCH AS A MATTRESS

[75] Inventor: Franciscus G. Savenije, Schalkhaar, Netherlands

[73] Assignee: Auping b.v., Netherlands

[21] Appl. No.: 705,694

[22] Filed: Feb. 26, 1985

Related U.S. Application Data

[63] Continuation-in-part of Ser. No. 634,026, Jul. 24, 1984, abandoned.

[30] Foreign Application Priority Data

Aug. 2, 1983 [NL] Netherlands ..... 8302733

[51] Int. Cl.[4] ..... A47C 23/08; A47C 27/00

[52] U.S. Cl. ..... 5/239; 5/241; 5/447; 5/464; 5/455

[58] Field of Search ..... 5/239, 241, 449–451, 5/455–457, 446, 447, 462, 464, 238

[56] References Cited

U.S. PATENT DOCUMENTS

| | | | |
|---|---|---|---|
| 2,184,808 | 12/1939 | Belian | 5/450 |
| 2,237,012 | 4/1941 | Sampson . | |
| 2,638,606 | 5/1953 | Austin | 5/449 |
| 2,748,399 | 6/1956 | Rockoff | 5/455 |
| 3,191,197 | 6/1965 | Frey | 5/241 |
| 3,289,221 | 12/1966 | Janapol | 5/239 |
| 3,340,548 | 9/1967 | Janapol | 5/464 |
| 3,538,521 | 11/1970 | Basner | 5/462 |
| 3,803,647 | 4/1974 | Reswick | 5/450 |
| 3,813,713 | 6/1974 | Kipfer | 5/238 |
| 4,383,342 | 5/1983 | Forster | 5/417 |
| 4,525,886 | 7/1985 | Savenije | 5/464 |

FOREIGN PATENT DOCUMENTS

| | | | |
|---|---|---|---|
| 0011755 | 6/1980 | European Pat. Off. . | |
| 759394 | 6/1953 | Fed. Rep. of Germany | 5/455 |
| 1273342 | 5/1972 | United Kingdom | 5/455 |

*Primary Examiner*—Gary L. Smith
*Assistant Examiner*—Michael F. Trettel
*Attorney, Agent, or Firm*—Leydig, Voit & Mayer

[57] ABSTRACT

Body support consisting of a number of tubular or sheath-shaped air chambers extending one next to the other in the transverse direction of the support and connected to one another, whereby the upper surface of each air chamber is provided with one or more strips of adapted width and/or flexibility, this strip or strips extending in the transverse direction of the body support, and therefore in the longitudinal direction of each air chamber, or being composed of parts, which strips when the support is under load, effect an adaptation to the different volume-to-weight ratios of the various parts of the human body.

18 Claims, 16 Drawing Figures

BODY SUPPORT, SUCH AS A MATTRESS

This is a continuation-in-part of U.S. Ser. No. 634,026 filed July 24, 1984, now abandoned.

The invention relates to a body support consisting of a number of tubular or sheath-shaped fluid chambers extending one next to the other in a direction transverse to a primary axis of the support and connected to one another with their upper surfaces cooperating with means for controlling the deflection of a top layer or body support surface which, when the support is under load, effect an adaptation to the different volume-to-weight ratios of the various parts of the human body.

From Dutch preliminary published patent application No. 7906927 an inflatable cushion element is known which consists of a number of tubular elements which lie one next to the other and extend in a direction transverse to the primary axis to the support, and which are connected together and are conjointly inflatable.

From Dutch patent application No. 8200401, which does not constitute a prior art publication, a body support is known which likewise consists of tubular or sheath-shaped air chambers extending in a direction transverse to the primary axis of the support with their upper surfaces cooperating with means which, when the support is under load, effect an adaptation to the different volume-to-weight ratios of the various parts of the human body.

The body support according to this earlier proposal is based on the concept that an ideal body support can be achieved if, with the same pressure in all the air chambers, the inward deflection is made dependent on the dimensions of a pressure member laid between the body and the air chamber and having a surface such that it can bring about the desired greater or lesser inward deflection.

The present invention seeks to provide the simplest possible and compact construction while retaining the adaptation to the different weight-to-volume ratios of the parts of the human body.

According to the present invention, this aim is primarily achieved by a body support having a plurality of chambers, filled with a fluid, such as air, in which the upper surface of each fluid chamber is provided with one or more elongated members or strips of varying deflectability, obtained by varying width and/or flexibility, this strip, strips or strip parts extending in a direction transverse to the primary axis, such as the longitudinal axis, of the body support, and therefore parallel to the longitudinal direction of each fluid chamber. The primary axis of the body support, which in most instances corresponds to the longitudinal axis of the body support, is the axis which is adapted to lie parallel to the centerline of a human body lying on the support. On the upper surfaces of the fluid chambers, strips are thus laid which, through their width and/or their properties with respect to stiffness or flexibility, determine the extent to which inward deflection will occur under load, and/or the form of this deflection.

Thus, according to the invention strips or strip parts which are stiff can be used. This does not mean that they cannot bend, but their elasticity and flexibility may be somewhat limited or negligible. In this situation, the width of the strips predominantly governs the extent of the inward deflection. Narrow strips will permit deeper inward deflection than wide strips. The inward deflection then, however, takes place mainly over the whole width of the body support.

This ability to use relatively stiff strips and to make the greater or lesser inward deflection dependent on their area has the disadvantage that, if the strips are of slight thickness, they will sink into the fluid chamber if they are narrower than the fluid chamber. According to the invention it is then preferable to bring about the variation of inward or downward deflection by varying flexibility, in particular elasticity.

Thus, the strip may consist of a plurality of short pieces of relatively stiff material which are articulated to one another.

Through variation of the material, that is to say by using materials having different moduli of elasticity, control of inward deflection can be achieved.

This can also be achieved by varying the moment of resistance over the length of the strip, or by using strips having different moments of resistance but of the same material. An elastic strip of this kind can also be obtained in many other ways. Moreover, the strip may be composed of a flat inflated tube able to bend to a greater or lesser extent in dependence on its inflation. The strip may also be composed of expanded plastic material to which the desired properties are given, and if necessary these strips of expanded plastic material may be covered on the top and bottom surfaces with a flexible non-extensible material, whereby the strip of expanded plastic material is given a higher moment of resistance.

The flexible strip may also be given on its upper surface a ribbed profile, which gives a certain flexibility to the strip in the longitudinal direction or parallel to the primary axis of the support, that is to say transverse to the direction of the longitudinal axis of the strip, and also, in the longitudinal direction of the strip, that is to say a predeterminable moment of resistance which determines flexibility transverse to the direction of the primary axis of the body support.

If stiff strips are used, these may consist of slats, for example wooden slats. However, they may preferably consist of strips of suitable plastic material, such as glass fiber reinforced polyester.

In general, the means for controlling deflection of the body contacting surface of the support can be achieved in numerous ways by selection of the shape and material of the longitudinal members' strips.

For fastening purposes it is expedient to provide or fasten on the top surface of each fluid chamber a cover-like sleeve, into which the strips or slats can be inserted. This will, in addition, permit subsequent modification.

According to the invention the support may consist of two layers or sheets of a fluid-tight plastic material which are welded together at their peripheral edges and are joined together, at spaced apart intervals, transversely to the longitudinal direction or primary axis of the support by cross seams in such a manner as to define through openings, appearing as tube-like inverted troughs or sheaths lying one next to the other. According to the invention, however, the support preferably consists of a flat bottom layer with upstanding side edges around it, and the fluid chambers consist of side and top walls which are inverted U-shape in section, which are joined together by side surfaces facing one another, at a distance from the bottom layer, in such a manner that slight clearance exists between the side surfaces of adjacent fluid chambers, while the distance between this connection and the bottom layer forms a passage space or gap therebetween for fluid communication between adjacent fluid chambers, the side surfaces of the top and bottom fluid chambers being respectively tightly connected to the side walls lying transversely thereto. In the loaded condition the clearance between adjacent fluid chambers no longer exists. It is therefore important that the walls should be able to move relative to one another and that they should therefore be made of materials having a low coefficient of friction. The passage gap can then ensure the damping, which is known per se, when a fluid, such as air, flows from one chamber to the other, and this damping can be made adjustable, for example by disposing in the gap in question an inflatable cushion which fills at least a part of the gap.

According to the invention the support may also consist of a number of separate fluid chambers disposed one next to the other and joined together by means of fluid-tight rapid action couplings.

A simple solution for producing a support of this kind consists in that each fluid chamber disposed between end chambers is in the form of a fluid-fillable or inflatable bag of rectangular section with one or more fluid coupling members in one long side wall and with complementary fluid coupling members in the other long side wall, in such a manner that all the coupling members lie in line with one another and the end chambers have only coupling members of one or the other type. The fluid chambers then need merely be connected together. Each of the chambers can then have an appropriately adapted upper surface. With the aid of chambers having different types of surface any desired support can be achieved in a simple manner.

In order to form a mattress the entire arrangement is preferably enclosed all around in layers of a foam rubber or foam plastics material.

In this way it is possible to produce a body support in the form of a mattress which with respect to dimensions entirely corresponds to a normal mattress, for example one made of foam material, but whose properties are or can be entirely adapted to the requirements of the user.

The invention will now be further explained with the aid of the drawings.

Figure 1:
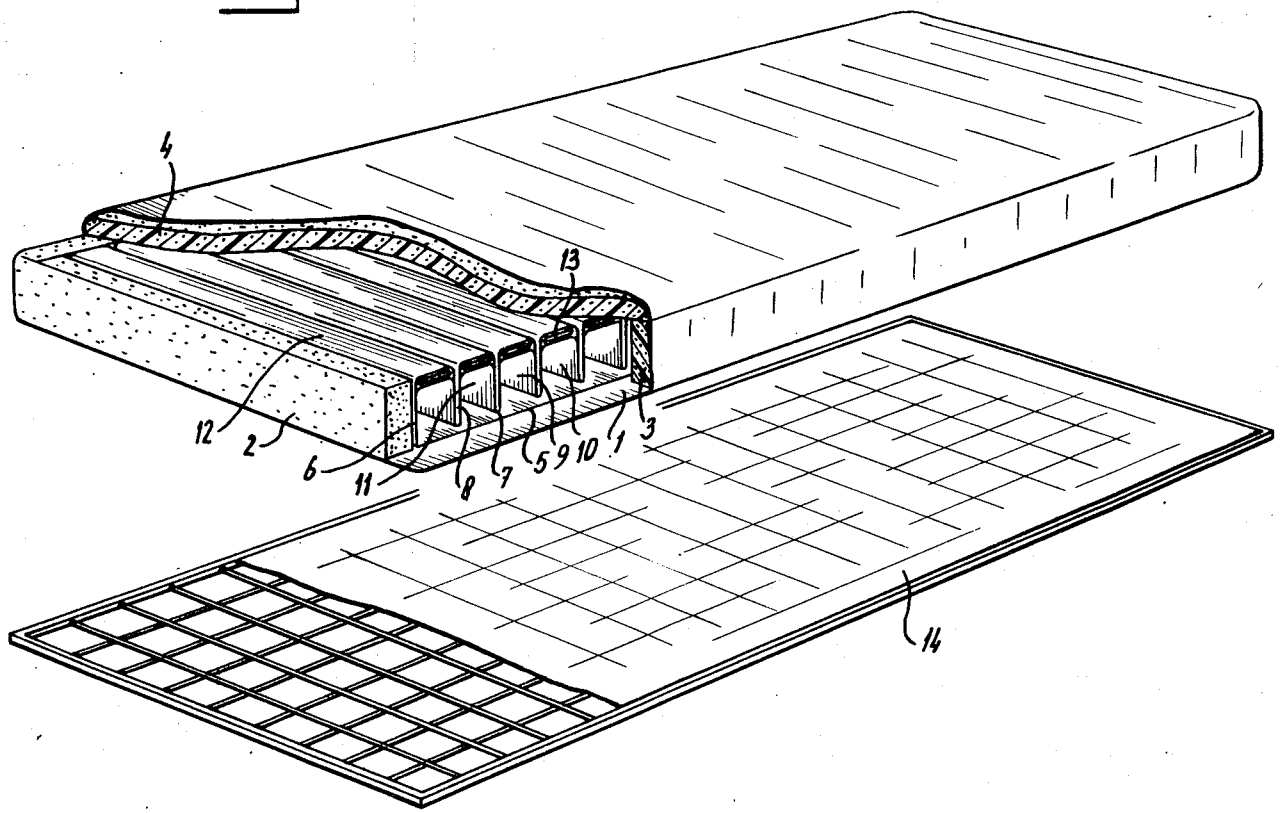
FIG. 1 shows in perspective and partly in section a body support according to the invention.

FIG. 1 shows a mattress consisting of a bottom layer 1 of foam material, edge strips 2 and 3 of foam material extending therearound, and a top layer 4 of foam material. In the hollow space defined by the top and bottom layers and edge strips lies an inflatable body defined by a bottom layer or surface 5, side edges or walls 6 extending around the latter, and a top part which is composed of sheaths which have the shape of an inverted u and which are welded to one another at 7, at a distance from the bottom layer 5, leaving a free space 8 between each sheath. The distance between the joint 7 and the bottom layer 5 is such that fluid can flow, with or without throttling, from the one chamber 9 to the adjoining chamber 10 or 11.

On the top of each fluid chamber is formed a sleeve 12, into which a strip or member 13 is inserted.

The whole arrangement can rest on an undermattress or carrier 14 of suitable stiffness.

Figure 2:
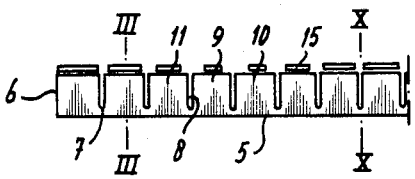
FIG. 2 shows diagrammatically a longitudinal section through a part of the interior of the mattress shown in FIG. 1.
Figure 3:
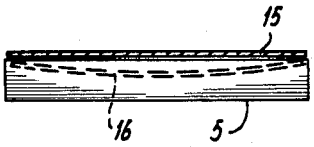
FIG. 3 is a section through an air chamber on the line III—III in FIG. 2.

The section in FIG. 2 shows the chambers 9, 10 and 11 and reveals that when the strips according to the invention are used, they may be of different widths, which can bring about a variation in flexing. If these strips, such as the strip 15, are relatively stiff, inward deflection will occur under load, as indicated by the broken line 16 in FIG. 3.

Figure 4:
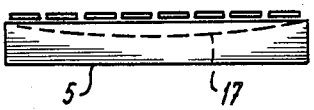
FIGS. 4, 5 and 6 are sections, corresponding to FIG. 3, of different variants of the strips.

The strip may, however, also be composed of parts or sections, as illustrated in FIG. 4, which optionally may be articulated or joined to one another, although each is in itself essentially stiff. A deflection line 17 as shown in FIG. 4 is then obtained.

Figure 5:
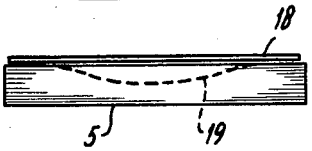

FIG. 5 shows a strip which is very flexible. The strip is shown at 18 and the deflection occurring under load is indicated by the line 19. Depending on the elasticity of the strip and its width, the desired deflection can be achieved.

Figure 6:
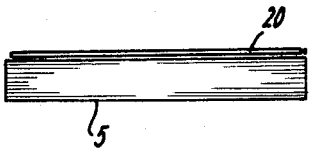

FIG. 6 shows an elastic strip which consists of a flat inflated tube 20. The deflection is comparable to that shown in FIG. 5.

Figure 7:
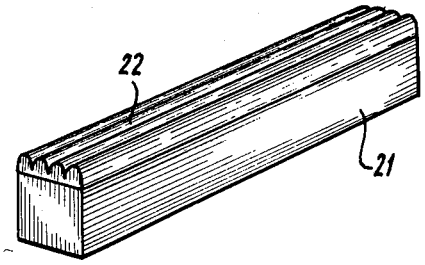
FIG. 7 shows in perspective another variant of fluid chamber and operatively associated strip.
Figure 8:
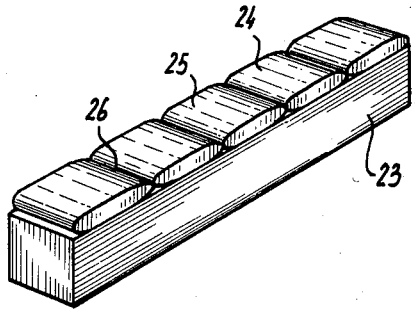
FIG. 8 shows in perspective another variant of strip and fluid chamber.

FIG. 7 shows in perspective a fluid chamber 21, on the surface of which is disposed a profiled strip 22, for example made of rubber, and FIG. 8 shows a fluid chamber 23 in which the strip consists of a number of cushions 24, 25 received in pockets and joined by cross seams 26, so that a hinge-like connection is obtained.

Figure 9:
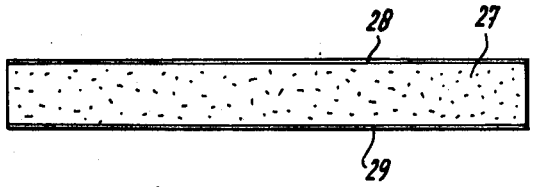
FIG. 9 shows a possible form of construction of the strip transmitting the load.

FIG. 9 shows a strip consisting of foam material 27, which at its top and bottom surface is covered by sheets 28 and 29, respectively. This may also be a thin elastic sheet of plastic material.

Figure 10:
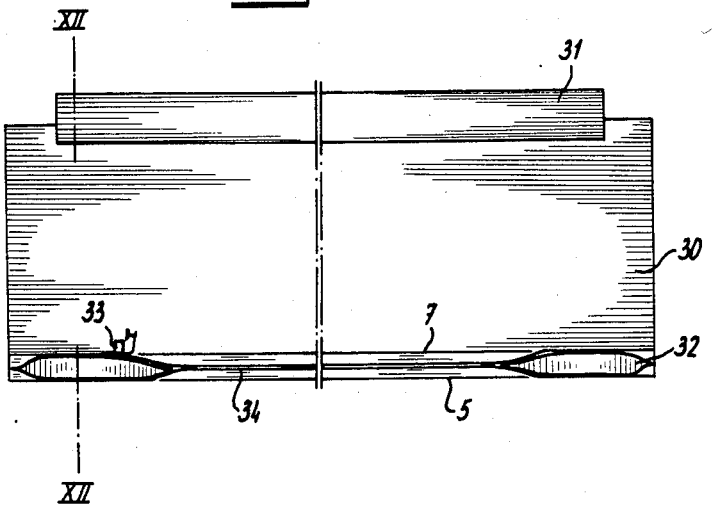
FIG. 10 is a section on the line X—X in FIG. 2.

FIG. 10 is a section on the line X—X in FIG. 2, and shows a fluid chamber 30 having on its surface a sleeve 31 for the insertion of a stiff or flexible strip. In the space between the joint 7 and the bottom layer 5 is disposed a cushion 32 which, as indicated by a valve means at 33, is fillable, as are the fluid chambers, with fluid such as air and is thereby inflatable at the site of the clearance 8, this cushion 32 partly filling the passage gap, with a passage where in the middle region 34 the cushion is not capable of being filled with fluid because the walls lying opposite one another are welded together.

Figure 11:
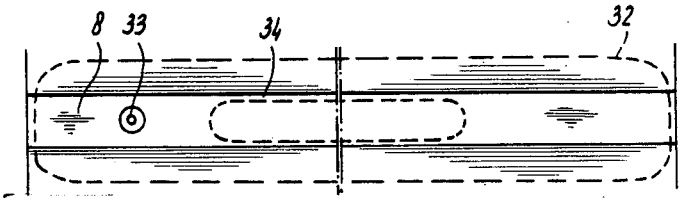
FIG. 11 is a bottom view of the embodiment shown in FIG. 10.

FIG. 11 shows a view of FIG. 10 from below, revealing that the inflatable portion of cushion 32 is annular.

Figure 12:
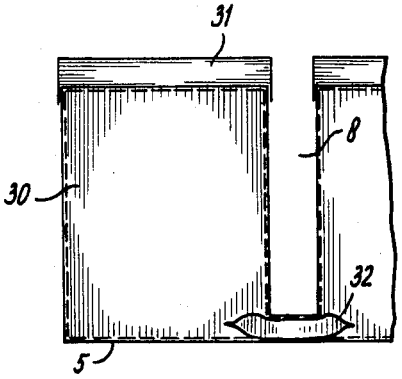
FIG. 12 is a section on the line XII—XII in FIG. 10.

From FIG. 12 can be seen how this cushion can close the passage. The extent to which the cushion is filled with fluid determines the throttling of fluid from one fluid chamber to the other.

Figure 13:
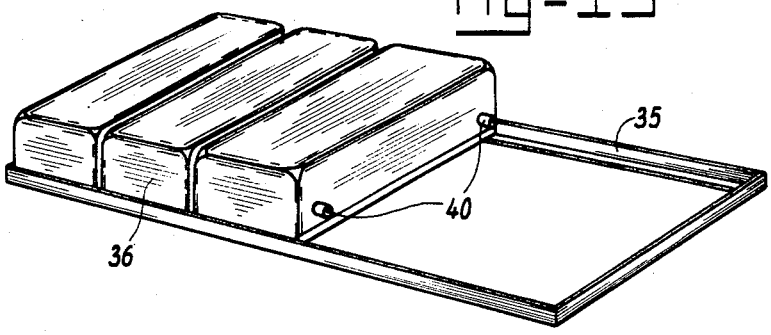
FIG. 13 shows in perspective another embodiment.
Figure 14:
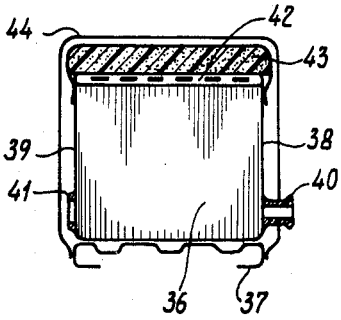
FIG. 14 is a section through one of the air chambers shown in FIG. 10.

FIG. 13 shows an embodiment in which a frame 35 holds a number of fluid chambers 36, for which purpose a number of plates, for example of the type shown in FIG. 14 and indicated at 37, are disposed in the frame. Each air chamber is provided in oppositely disposed side walls 38 and 39, respectively, with means for fluid communication, such as the complementary parts 40 and 41, respectively, of a coupling which enables the fluid chambers to be connected to one another in a row by inserting the coupling part 40 into the coupling part 41.

Each fluid chamber 36 has a correction 42 which is provided with strips and over which a foam layer 43 is laid. The whole arrangement may be enclosed in a cover 44.

Figure 15:
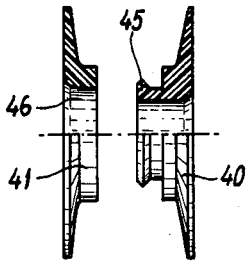
FIG. 15 shows a rapid action coupling in section.

FIG. 15 shows the two parts of the coupling, namely the part 40 and the part 41, partly in section and partly in elevation. The forms of construction of these couplings are such that when the projecting part 45 is pushed into the opening 46 a fluid tight, such as an airtight, connection is made.

By marketing fluid chambers having different correction layers, it is possible in a simple manner to assemble a body support having the desired properties.

Figure 16:
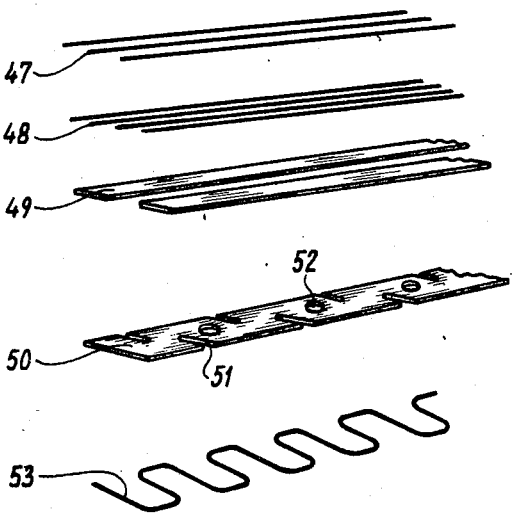
FIG. 16 shows a number of constructions of strips.

Finally, FIG. 16 shows a number of possible ways of making the correction layer.

From top to bottom, FIG. 16 first shows a number of steel rods 47, a number of glass fiber reinforced plastics rods 48, a number of leaf springs 49, a leaf spring 50 having a number of incisions 51 and perforations 52, and a zigzag spring 53. All these means can be placed in sleeves on the top layer of an air chamber.

I claim:

1. A body support device having a primary axis parallel to the direction of a center line of a human body which the support device is adapted to support comprising:

a plurality of interconnected tubular chambers adapted to be filled with a fluid medium arranged parallel to one another and perpendicular to the primary axis; and means for controlling deflection of a body in contact with an upper surface of the support device in accordance with the volume-to-weight ratios of the various parts of the human body which the body support device is adapted to support, said deflection-controlling means comprising separate elongated members of varying deflectability located at the upper surfaces of said tubular chambers, each member arranged parallel to the longitudinal axis of the tubular chamber with which it is associated, said elongated members formed from an elastic material, the modulus of elasticity of some of said elongated members differing from that of other elongated members.

2. A body support device according to claim 1 comprising a flat bottom layer having upstanding side edges therearound, said chambers having an inverted U shape configuration in transverse section defining thereby the top and side walls of each chamber which side walls are joined to one another at the outer facing surfaces of adjacent side walls at a distance from the bottom layer in such a manner that a clearance is formed between the upper portion of the outer facing side surfaces while the distance between the joined portions of the outer surfaces and the bottom layer forms a passage space between adjacent chambers, the upper and lower portions of the side surfaces forming part of the side walls, and the ends of the chambers being tightly connected to the upstanding side edges lying transversely thereto.

3. A body support device according to claim 2 wherein an inflatable cushion is disposed at least in a part of the passage space between the bottom layer and the side surfaces connected to one another to throttle the flow of fluid medium from one chamber to an adjacent chamber through the passage space.

4. A body support device according to claim 2 wherein each chamber arranged between end chambers comprises an inflatable bag of rectangular section having in the side wall of each chamber adjacent another chamber at least one detachable, fluid-tight, interengaging coupling member and in the side walls of each adjacent chamber at least one complementary detachable, fluid-tight, interengaging coupling member so arranged that all the coupling members lie in line with one another and the end chambers have only coupling members or complementary coupling members.

5. A body support device according to claim 1 wherein said fluid medium comprises air.

6. A body support device having a primary axis parallel to the direction of a centerline of a human body which the support device is adapted to support comprising:

a plurality of interconnected tubular chambers adapted to be filled with a fluid medium arranged parallel to one another and perpendicular to the primary axis; and means for controlling deflection of a body in contact with an upper surface of the support device in accordance with the volume-to-weight ratios of the various parts of the human body which the body support device is adapted to support, said deflection-controlling means comprising separate elongated flat members of varying deflectability located at the upper surfaces of said tubular chambers, each of said members arranged parallel to the longitudinal axis of the tubular chamber with which it is associated and each having an upper and lower surface, respectively, the length and width of which are substantially equal, which elongated members are formed from an elastic material, the moments of resistance to bending of some of said elongated members differing from that of other elongated members.

7. A body support device according to claim 6 wherein said fluid medium comprises air.

8. A body support device according to claim 6 comprising a flat bottom layer having upstanding side edges therearound, said chambers having an inverted U shape configuration in transverse section defining thereby the top and side walls of each chamber which side walls are joined to one another at the outer facing surfaces of adjacent side walls at a distance from the bottom layer in such a manner that a clearance is formed between the upper portion of the outer facing side surfaces while the distance between the joined portions of the outer surfaces and the bottom layer forms a passage space between adjacent chambers, the upper and lower portions of the side surfaces forming part of the side walls, and the ends of the chambers being tightly connected to the upstanding side edges lying transversely thereto.

9. A body support device according to claim 8 wherein an inflatable cushion is disposed at least in a part of the passage space between the bottom layer and the side surfaces connected to one another to throttle the flow of fluid medium from one chamber to an adjacent chamber through the passage space.

10. A body support device according to claim 8 wherein each chamber arranged between end chambers comprises an inflatable bag of rectangular section having in the side wall of each chamber adjacent another chamber at least one detachable, fluid-tight, interengaging coupling member and in the side walls of each adjacent chamber at least one complementary detachable, fluid-tight, interengaging coupling member so arranged that all the coupling members lie in line with one another and the end chambers have only coupling members or complementary coupling members.

11. A body support device according to claim 6 wherein the elongated members comprise flat inflated tubes.

12. A body support device according to claim 6 wherein the elongated members comprise foam material.

13. A body support device according to claim 12 wherein the elongated members of foam material are covered on their bottom and top surfaces with flexible, non-extensible material.

14. A body support device according to claim 12 wherein the elongated members have a ribbed profile on their upper surfaces.

15. A body support device according to claim 6 wherein the elongated members comprise slats.

16. A body support device according to claim 6 wherein the entire support is enclosed on all sides with layers of foam material.

17. A body support device according to claim 6 wherein said elongated members vary in width from each other.

18. A body support device according to claim 6 wherein said means for fluid communication comprises detachable, fluid-tight interengaging coupling members.

* * * * *